US009702644B2

(12) United States Patent
Daley, Jr. et al.

(10) Patent No.: US 9,702,644 B2
(45) Date of Patent: Jul. 11, 2017

(54) REGULATOR FOR A FIREARM AUTO LOADER

(71) Applicant: Sig Sauer, Inc., Newington, NH (US)

(72) Inventors: William C. Daley, Jr., Kingston, NH (US); David Michael Wilkes, Deerfield, NH (US); Douglas Aubin, Newmarket, NH (US); David Steimke, Epping, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 14/994,616

(22) Filed: Jan. 13, 2016

(65) Prior Publication Data

US 2016/0202006 A1 Jul. 14, 2016

Related U.S. Application Data

(60) Provisional application No. 62/102,728, filed on Jan. 13, 2015, provisional application No. 62/104,908, filed on Jan. 19, 2015.

(51) Int. Cl.
*F41A 5/26* (2006.01)

(52) U.S. Cl.
CPC ..... *F41A 5/26* (2013.01)

(58) Field of Classification Search
CPC ..... F41A 5/18; F41A 5/26; F41A 5/28
USPC ..... 89/191.01, 193
See application file for complete search history.

(56) References Cited

U.S. PATENT DOCUMENTS 2,872,851 A * 2/1959 Katz ..... F41A 5/28 89/193
2,895,383 A * 7/1959 Reed ..... F41A 5/28 89/191.01
2,987,968 A * 6/1961 Janson ..... F41A 5/28 89/193
3,333,510 A * 8/1967 Muhlemann ..... F41A 5/26 89/193
3,968,727 A * 7/1976 Hyytinen ..... F41A 5/28 89/191.02
3,982,468 A * 9/1976 Browning ..... F41A 5/28 89/193

(Continued)

*Primary Examiner* — Bret Hayes
(74) *Attorney, Agent, or Firm* — Finch & Maloney PLLC

(57) ABSTRACT

A regulator that controls an amount of energy provided to an auto loader for rounds having different gun powder loads is provided. The regulator includes a chamber, and a piston in fluid communication with the chamber. The regulator may further include a throttling valve having a first position in which pressurized combustion gas from the gas port of a barrel of a firearm can flow into the chamber, and a second position in which pressurized combustion gas from the gas port of a barrel of a firearm cannot flow into the chamber. The throttling valve is configured to move from the first position to the second position when pressure in the chamber exceeds a threshold level. The regulator may include an expansion valve in fluid communication with the chamber and arranged to move from a first position to increase a volume of the chamber when pressure in the chamber exceeds a threshold level. The regulator may include a valve including a vent hole, where the valve is in fluid communication with the chamber and is arranged to vent combustion gas from the chamber through the vent hole.

19 Claims, 10 Drawing Sheets

(56) References Cited

U.S. PATENT DOCUMENTS

| | | | | | |
|---|---|---|---|---|---|
| 4,324,170 | A * | 4/1982 | Healy | F41A 5/26 | 89/159 |
| 4,414,880 | A * | 11/1983 | Throner | F41A 5/28 | 89/193 |
| 4,702,146 | A * | 10/1987 | Ikeda | F41A 5/28 | 89/193 |
| 5,404,790 | A * | 4/1995 | Averbukh | F41A 5/28 | 89/193 |
| 2013/0025445 | A1* | 1/2013 | Windauer | F41A 5/28 | 89/193 |
| 2014/0083286 | A1* | 3/2014 | Gomez | F41A 5/18 | 89/193 |
| 2016/0161200 | A1* | 6/2016 | Windauer | F41A 5/28 | 89/193 |

* cited by examiner

REGULATOR FOR A FIREARM AUTO LOADER

CROSS-REFERENCE TO RELATED APPLICATIONS

This application claims the benefit of U.S. Provisional Application No. 62/102,728, filed Jan. 13, 2015, and also claims the benefit of U.S. Provisional Application No. 62/104,908, filed Jan. 19, 2015, both of which are incorporated by reference herein.

TECHNICAL FIELD

The present disclosure relates to auto loaders for automatic and semi-automatic firearms, and particularly to a regulator for an auto loader.

BACKGROUND

Automatic or semi-automatic firearms typically include an auto loader that cycles a bolt carrier and bolt backward and forward after the firearm is fired. Depending on the particular firearm, the auto loader may be propelled by the recoil of the firearm and/or by the expanding gas associated with the discharge of a round. Rearward movement of the bolt carrier and bolt causes an extractor to engage and draw a spent round from the firing chamber. The bolt returns forward, often under action of a spring, after the round is ejected from the firearm. Forward movement of the bolt engages a fresh round from a magazine and pushes the round into the firing chamber for subsequent firing.

Automatic or semi-automatic firearms that utilize expanding combustion gas to power an auto loader may draw combustion gas from the firearm barrel after a round is fired. The pressurized combustion gas urges a piston that, in turn, moves the bolt of the firearm rearward to unlock the breach of the firearm, extract a round from the firing chamber and eject the spent round from the firearm. A spring typically urges the bolt forward to feed a fresh round into the firing chamber and to lock the firing chamber, completing the firing cycle of the firearm.

SUMMARY

In one embodiment, a regulator for a gas operated firearm auto loader is provided. The regulator includes a chamber constructed and arranged to receive pressurized combustion gas from a gas port of a barrel of the firearm when a round is fired from the firearm. The regulator also includes a piston having a piston head in fluid communication with said chamber, the piston is constructed and arranged to move away from a firing position to actuate at least a portion of a cycle of the firearm when urged by pressurized combustion gas received in said chamber. The regulator also includes a throttling valve in fluid communication with said chamber, the throttling valve has a first position in which pressurized combustion gas from the gas port of a barrel of a firearm can flow into the chamber, and a second position in which pressurized combustion gas from the gas port of a barrel of a firearm cannot flow into the chamber, and the throttling valve is configured to move from the first position to the second position when pressure in the chamber exceeds a threshold level.

According to another embodiment, a regulator is disclosed for a gas operated automated firearm. The regulator includes a gas chamber constructed and arranged to receive pressurized combustion gas from a gas port of a barrel of the firearm when a round is fired from the firearm. A piston has a piston head in fluid communication with said gas chamber and the piston is constructed and arranged to move away from a firing position to actuate at least a portion of a cycle of the firearm when urged by pressurized combustion gas received in the gas chamber. An expansion valve is in fluid communication with the gas chamber and the expansion valve is constructed and arranged to move from a firing position to increase a volume of said gas chamber when pressure in the gas chamber exceeds a threshold level.

According to yet another embodiment, a regulator is disclosed for a gas operated automated firearm. The regulator includes a gas chamber having an intake that receives pressurized combustion gas from a gas port of a barrel of the firearm when a round is fired. A piston has a piston head in fluid communication with said gas chamber, and the piston is constructed and arranged to move a bolt carrier of the firearm by pressurized combustion gas in the gas chamber to actuate at least a portion of an automated cycle of the firearm. A valve includes a vent hole and the valve is in fluid communication with the gas chamber to vent combustion gas from the gas chamber through the vent hole.

According to another embodiment, a method of regulating gas pressure in gas operated firearm automation is disclosed. The method includes receiving pressurized combustion gas in a gas chamber of a regulator upon firing of a firearm. A bolt carrier of the firearm is moved by urging a piston with the pressurized combustion gas in the gas chamber of the regulator. Combustion gas from the gas chamber is vented through a vent hole when pressure in the gas chamber exceeds a set point.

BRIEF DESCRIPTION OF THE FIGURES

In the drawings, different embodiments of the invention are illustrated in which.

DETAILED DESCRIPTION

Figure 1:
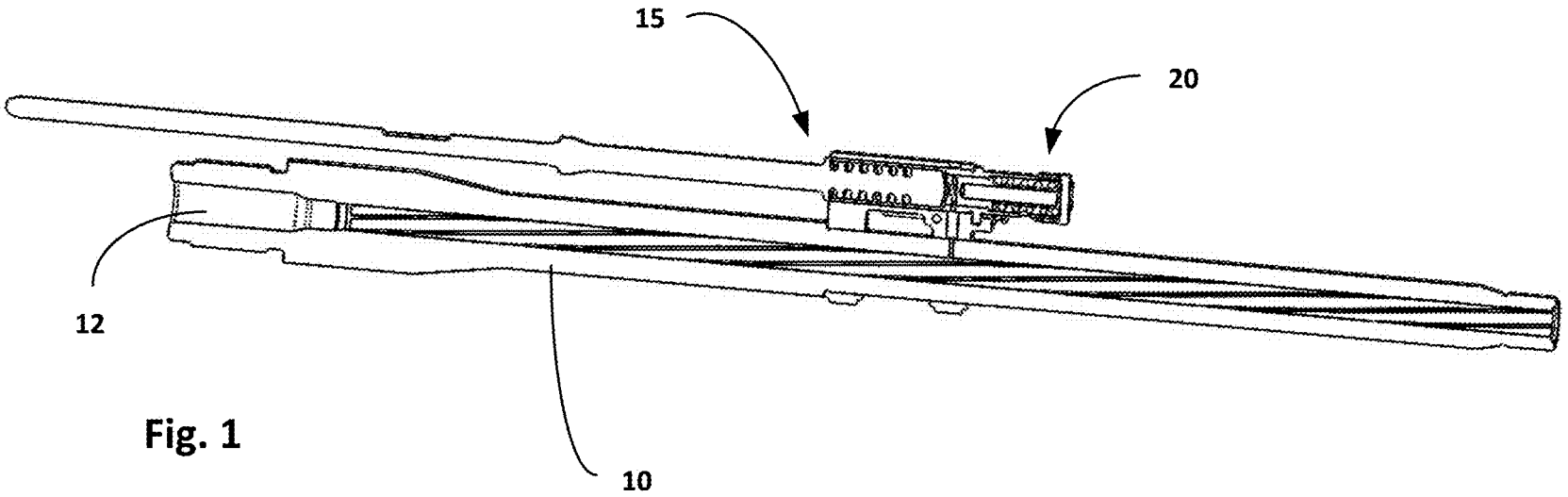
FIG. 1 shows a cross sectional view of the barrel and auto loader/gas block of a firearm that includes a regulator, according to one embodiment.

Variation in the amount of gun powder loaded into firearm rounds can cause different amounts of energy to be provided to an auto loader of an automatic and/or semi-automatic weapon. Suppressors may cause different amounts of energy to be provided to an auto loader by creating increased back pressure in a firearm barrel when installed. Providing inadequate energy to an auto loader can prevent an auto loader from cycling properly. This can result in a spent round being left in the firearm after firing. On the other hand, providing excess energy to an auto loader can cause a firearm to cycle too rapidly, which may negatively affect controllability and wear of the firearm.

Aspects of the present invention are directed to a regulator for an auto loader that can control the amount of pressure and resulting energy in the regulator and auto loader. In particular, aspects of the present invention are directed to a regulator that can prevent the pressure within the regulator from reaching a predetermined high pressure. One approach considered by the inventors of the present invention to prevent these undesirable high pressures is to provide a mechanism for reducing the pressure. For example, one way to reduce the pressure that is discussed below is to implement a valve which increases the volume of the regulator chamber when the pressure in the chamber exceeds a threshold level. Another way to reduce chamber pressure that is discussed below is to implement a valve that includes a vent hole that is configured to vent combustion gas from the chamber when the pressure in the chamber exceeds a threshold level. Another approach considered by the inventors of the present invention to prevent these undesirable high chamber pressures is to provide a mechanism which prevents the combustion gases from entering the chamber once pressure in the chamber exceeds a threshold level.

As set forth in greater detail below, one aspect of the present invention is directed to a regulator for an auto loader that includes a throttling valve. The throttling valve is movable between a first position in which pressurized combustion gas can flow into the regulator chamber, and a second position in which pressurized combustion gas cannot flow into the chamber. The throttling valve is configured to move from the first position to the second position when pressure in the chamber exceeds a threshold level.

Another aspect of the present invention outlined below is directed to a regulator for an auto loader which includes a variable volume chamber. In particular, the regulator includes an expansion valve in fluid communication with the chamber. The expansion valve may be configured to increase the volume of the chamber when the chamber pressure exceeds a threshold level. By increasing the chamber volume, the chamber pressure decreases.

Yet another aspect of the present invention outlined below is directed to a regulator for an auto loader which includes a valve with a vent hole. As set forth in more detail below, the valve may initially close off the vent hole so that the vent hole is not in fluid communication with the chamber. As the chamber pressure increases, the valve may move such that the vent hole becomes in fluid communication with the chamber. Thus, as the chamber pressure reaches a threshold level, the valve moves to expose the vent hole to the chamber, allowing the combustion gases to vent out of the chamber through the vent hole. By venting the combustion gases out of the vent hole, the chamber pressure decreases.

Described herein are embodiments of a regulator that control the amount of energy provided to an auto loader for rounds having different loads. Some embodiments of the regulator may include a variable volume gas chamber in which combustion gases are received before acting to cycle the firearm. For rounds with higher loads, the gas chamber volume may be increased so that the rate at which pressure builds in the gas chamber is reduced and/or so that the peak pressure achieved in the gas chamber is reduced. For rounds having lower loads, the gas chamber may increase in volume by a lesser amount or not at all ahead of the auto loader being actuated. In this respect, intended auto loader operation of a firearm may be maintained for rounds having different loads without reconfiguring the regulator or auto loader of a firearm. Additionally, the regulator may promote consistent operation of an auto loader as a firearm becomes fouled through normal use between cleanings.

Figure 2:
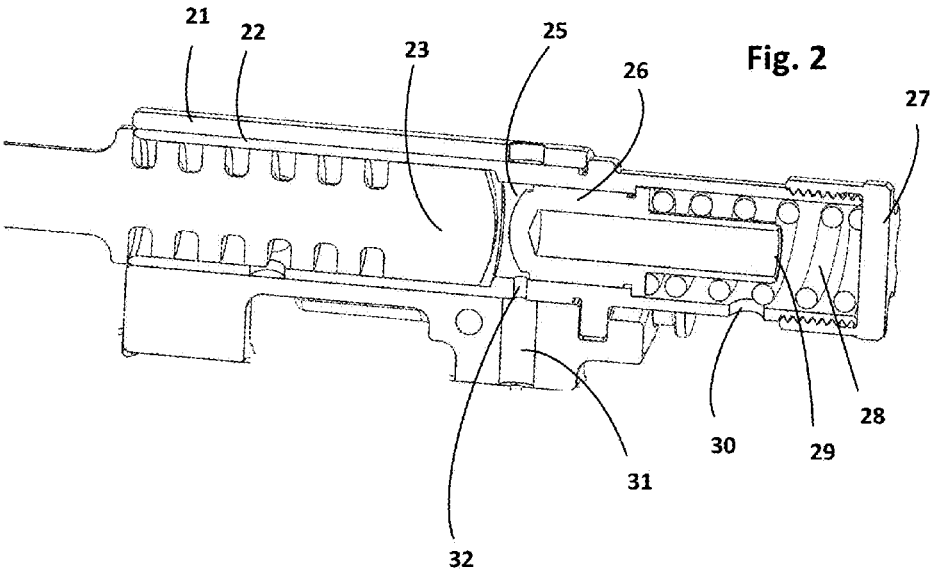
FIG. 2 shows a cross sectional view of the regulator shown in FIG. 1 in a firing position, prior to a round being fired, according to one embodiment.
Figure 3:
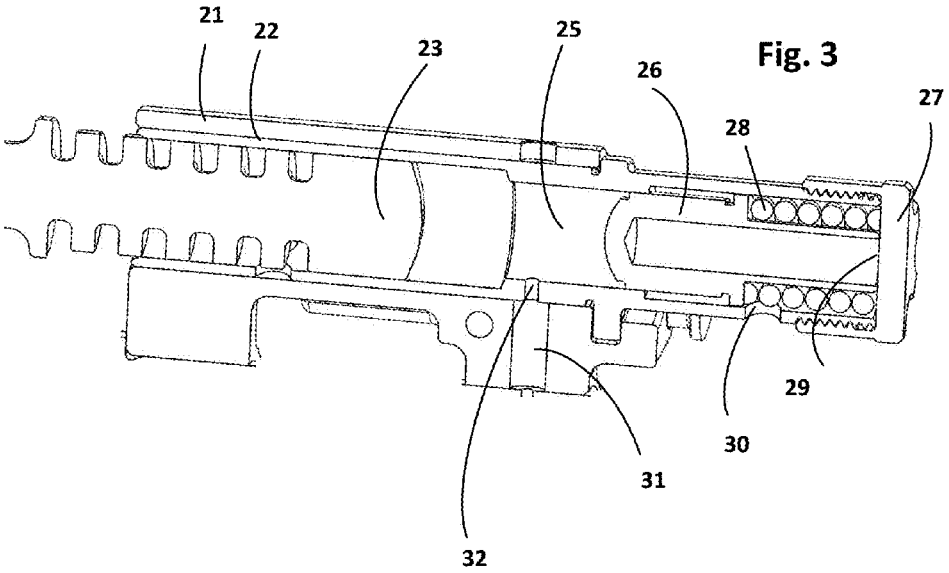
FIG. 3 shows a cross sectional view of the regulator shown in FIG. 1 in a position after firing, with the auto loader in motion to actuate at least a portion of the firing cycle of the firearm and the expansion valve moved away from the firing position to increase the volume of the gas chamber.

Turn now to the figures, FIG. 1 shows a cross sectional view of a barrel 10 and the gas block of an auto loader 15 for a firearm. As shown in FIG. 2, the auto loader 15 includes a piston 23 that reciprocates from a forward firing position (shown in FIG. 2), to a rearward position (shown in FIG. 3) to, in turn, move a bolt (not shown) of the firearm through at least a portion of a firing cycle of the firearm when a round is fired from the firing chamber 12. The regulator 20 includes an expansion valve 26 that moves forward, as shown in FIG. 3, to increase the volume in the gas chamber 25 when a threshold pressure is exceeded in the gas chamber 25, such as may occur when high load rounds are fired from a firearm.

The auto loader 15 is fed by pressurized combustion gas received from a gas port in the barrel 10 of a firearm. When a round is fired, pressurized combustion gas passes through the gas port in the barrel 10 and through one or more corresponding gas ports 31, 32 of the auto loader. Combustion gas may be received by a gas chamber 25 within the auto loader to allow accumulation ahead of actuating the piston 23 of the auto loader 15. As may be appreciated, a larger gas chamber 25 volume may reduce the rate at which pressure builds within the gas chamber 25, all else constant. Such a reduction in rate may increase the time that it takes gas pressure to begin moving the piston of the auto loader or the speed with which the piston 23 is moved, thereby preventing a firing rate of an automatic firearm from increasing. The overall amount of energy applied to the piston of the auto loader, among other components, may also be reduced. Conversely, a smaller gas chamber may be desirable to facilitate a more rapid rise in gas pressure and quicker actuation of an auto loader.

Gas chamber or chamber, as used herein, refers to the volume in the auto loader of a firearm that receives combustion gases from the port of a firearm barrel for direct action on the piston (or other mechanism) of an auto loader.

FIGS. 1-5 illustrate a regulator with an expansion valve 26 that is configured to move to increase the volume of the gas chamber when pressure in the chamber exceeds a threshold level. With respect to these embodiments that feature a variable volume chamber, the volume that is made available to combustion gas as the auto loader piston 23 is moved rearward to cycle the firearm is not considered a portion of the gas chamber. In other words, the regulator is configured such that the volume of the chamber can increase without movement of the piston. For example, in one embodiment, the expansion valve is configured to move to increase the volume of the chamber before the auto loader piston 23 moves to cycle the firearm.

The example embodiment of FIGS. 2 and 3 includes a regulator having an expansion valve 26 to produce a variable volume gas chamber 25. As discussed in more detail below, a biasing element 28 urges the expansion valve toward a firing position (as shown in FIG. 2) where the volume of the gas chamber 25 is minimized. Pressure builds in the gas chamber as combustion gases are received through port 32 of the regulator after a round is fired. When pressure exceeds a threshold level, as may occur when a high load round is fired, the expansion valve moves against the biasing element 28 to increase the volume of the gas chamber, as shown in FIG. 3.

The term "firing position" as used herein with references to the auto loader piston and/or the regulator, refers to the position in which the auto loader mechanism and/or regulator exists when the firearm is readied for firing during the firing cycle. In the illustrative embodiment of FIG. 2, this includes the piston 23 of the auto loader at a forward position, as is associated with a bolt and bolt group being at forward position with a round in the firing chamber ready for firing. The expansion valve of the regulator is also positioned so as to minimize the volume of the gas chamber 25, as shown in FIG. 2.

A regulator may be tuned to increase or otherwise alter the volume of the gas chamber upon different occurrences. According to some example embodiments, the expansion valve is tuned to move from the firing position when a threshold pressure level is exceeded in the gas chamber. The threshold level may be set so that the gas chamber volume does not increase when low load rounds are fired from the firearm. In this respect, most if not substantially all of the energy provided to the auto loader from combustion gas received in the gas chamber 25 may be delivered to the piston 23 of the auto loader 15 to cycle the firearm. The regulator and auto loader may be designed such that the firearm cycles at a desired rate without the expansion valve moving from the firing position (FIG. 2) when low road rounds are fired.

In one embodiment, the expansion valve of the regulator may be actuated and moved from the firing position when higher load rounds are fired to prevent excess energy from being transferred to the auto loader. The regulator may be tuned so that the pressure level achieved in the gas chamber for a higher load round exceeds a threshold value for moving the expansion valve from the firing position. The expanding gas chamber may then offer more volume for combustion gas entering the gas chamber and consequently reduce the pressure level that might otherwise be obtained in the gas chamber. Energy of the combustion gas may additionally be used to move the expansion valve 26, thus limiting and/or delaying the delivery of such energy to the piston 23 of the auto loader 15. Reducing the peak pressure levels, amount of energy and/or rate at which energy is delivered to the auto loader may prevent a firearm from cycling too fast or with excessive force when higher load rounds are fired.

Regulators may be constructed so that the escape of combustion gas from the gas chamber or other portions of the auto loader and/or regulator is prevented. As may be appreciated, auto loaders are typically positioned on or near the receiver of a firearm, where an operator may position their hand when firing. Preventing the escape of hot combustion gases to the external environment near the auto loader and/or regulator may prevent unintended injury of an operator, according to some example embodiments. The expansion valve 26 in the embodiment of FIGS. 2 and 3 includes a piston that reciprocates within a regulator housing 22 between the firing position and an actuated position. The interface between the outer, cylindrical walls of the piston 26 and the housing 22 may be a precision fit to prevent the passage of combustion gases there between. According to other embodiments, the interface between the piston and housing may include piston rings to prevent the escape of combustion gases. Other arrangements are also contemplated.

Any combustion gases that do pass by the expansion valve, such as blowby gases that leak through the gap between the expansion valve 26 and regulator housing 22, may be allowed to escape from the firearm through a blowby vent 30. In this respect, gas pressure (or vacuum) is prevented from building behind the expansion valve, which might otherwise alter operating characteristics of the regulator. Combustion gases that actuate the expansion valve of the regulator but that do not blow by the expansion valve may be directed back into the barrel of the firearm during the firing cycle. In the illustrated embodiment of FIGS. 2-3, combustion gases are urged out of the gas port 32 of the gas chamber 25 when the auto loader piston 23 and the expansion valve 26 returns to the firing position, after a round is fired.

The expansion valve may include various features to guide the valve through a range of motion. As shown in FIG. 2, the expansion valve 26 may include a shoulder that engages a corresponding shoulder of the regulator housing 22 when the expansion valve 26 is in the firing position. The opposite end of the expansion valve includes a positive stop 29 that contacts an end cap 27 of the regulator housing 22 to limit travel of the expansion valve.

A helical spring urges the expansion valve toward the firing position in the illustrated embodiments. It is to be appreciated, however, that other types of biasing elements 28 may be used to position the expansion valve, including but not limited to, disc type springs such as Belleville washers, coil springs, resilient polymers, gas-filled chambers, and the like. Biasing elements may be made of different materials, including, but not limited to, spring steel, stainless steel, various alloys and polymers. One of ordinary skill in the art would appreciate that the stiffness or spring constant of a spring, the preload set by the construction of the regulator and allowed amount of travel of the expansion valve may be set by a designer, among other factors, to establish the dynamics of a regulator, including the threshold pressure at which the expansion valve initially moves from the firing position.

The regulator may include various features to control the flow of combustion gas into the gas chamber. In the example embodiment of FIGS. 2 and 3, combustion gas enters a gas port 31 of the auto loader housing 21 and a gas port 32 of the regulator housing 22 ahead of entering the gas chamber 25. The gas port 32 of the regulator housing has a smaller cross section than that of the gas port 31 of the auto loader housing 21 to help control the flow of pressurized combustion gas to the auto loader. The size of gas port 32 may be established to accommodate a desired rate of combustion gas flow (or range of flow rates) in a particular firearm. In some embodiments, the size of the gas port 32 can be adjusted such as by changing an orifice or adding a sleeve.

Regulators may include features to limit or throttle an amount of combustion gas that enters the gas chamber after the expansion valve has been actuated. In this respect, the expansion valve 26 can act as a throttling valve. By way of example, in the embodiment of FIG. 4, combustion gas is initially admitted to the gas chamber by passing through an annular groove 33 in the outer cylindrical surface of the expansion valve 26 and then through radially oriented ports 35 and an axially oriented port 34 in the face of the expansion valve. Movement of the expansion valve from the firing position, however, causes at least a portion of the outer cylindrical surface of the expansion valve to at least partially cover the gas port, reducing the area of flow and reducing or preventing the further admission of combustion gas to the gas chamber and consequently limiting the flow of combustion gases through the port and, as a result, limiting the energy that is provided to the auto loader. This is one exemplary embodiment of the expansion valve 26 acting as a throttling valve. Other embodiments are discussed in greater detail below.

Figure 4:
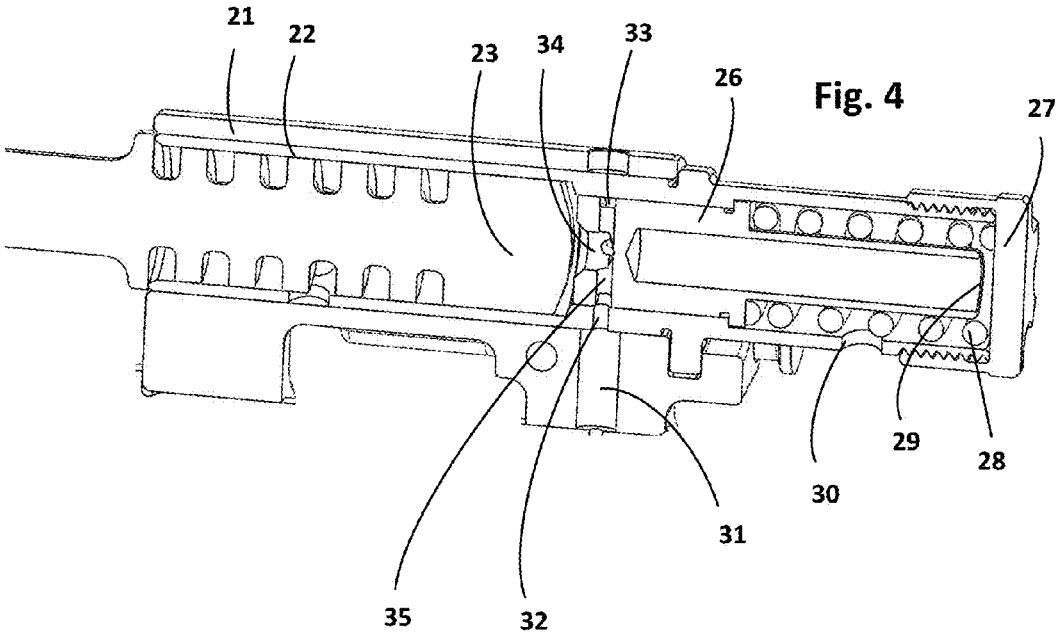
FIG. 4 shows another embodiment of a regulator for an auto loader that includes a throttle/throttling valve that prevents combustion gas from entering the gas chamber of the regulator after the expansion valve/throttling valve has moved from the firing position.
Figure 5:
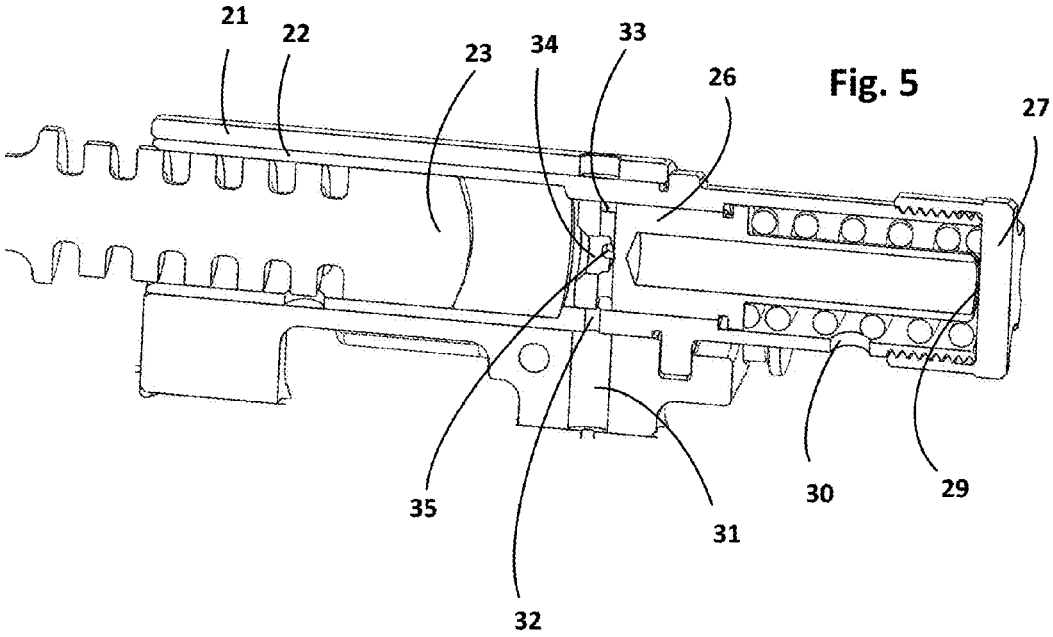
FIG. 5 shows the embodiment of FIG. 4 in a position after firing, with the auto loader in motion to actuate at least a portion of the firing cycle of the firearm, and where the gas port to the gas chamber of the regulator is partially blocked.

The expansion valve of the example embodiment shown in FIGS. 4 and 5 includes a positive stop 29 constructed to prevent motion of the expansion valve beyond a position where the port 32 to the gas chamber is throttled. In this respect, the movement of the expansion valve beyond a position where gas port 32 is throttled and further admission of combustion gases to the chamber is prevented, once the gas port 32 is throttled.

Figure 6:
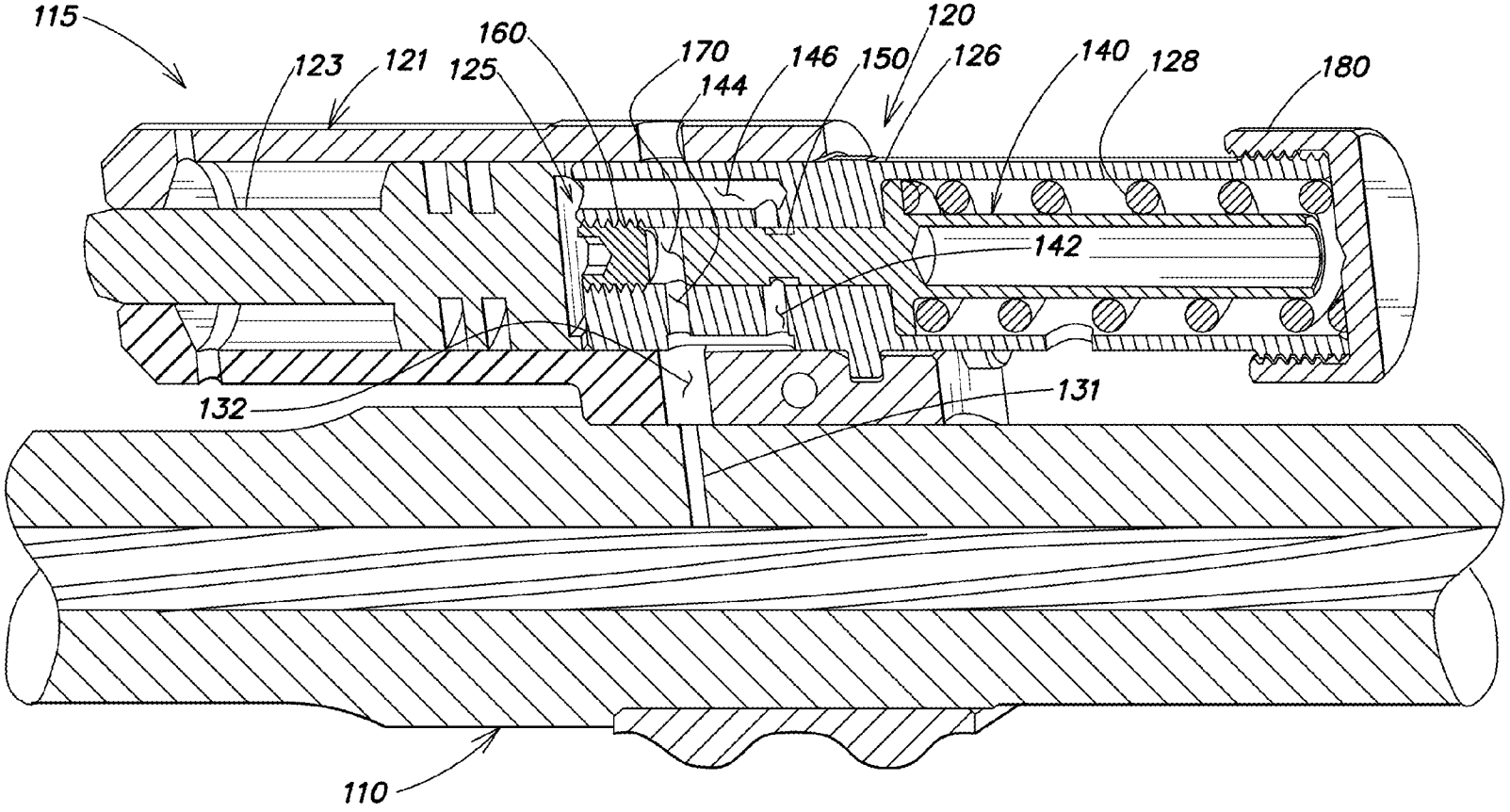
FIG. 6 shows another embodiment of a regulator for an auto loader that includes a throttling valve.

Turning now to FIG. 6, another embodiment of a regulator 120 for an auto loader 115 that includes a throttling valve 140 is illustrated, and will now be described. As mentioned above, the throttling valve 140 is configured to prevent the combustion gases from entering the regulator chamber once pressure in the chamber exceeds a threshold level. In this illustrative embodiment, the throttling valve 140 is received within a valve body 126, and the valve body 126, in turn, is received within the auto loader housing 121. As discussed above with respect to the other illustrative embodiments, the auto loader 115 includes a piston 123 that reciprocates between a forward firing position (similar to FIG. 2) to a rearward position (similar to FIG. 3) to move a bolt (not shown) of the firearm through at least a portion of a firing cycle of the firearm when a round is fired from the firing chamber.

The auto loader 115 is fed by pressurized combustion gas received from a gas port 131 in the barrel 110 of a firearm. When a round is fired, pressurized combustion gas passes through the gas port 131 in the barrel 110 and through one or more corresponding gas ports 132 of the auto loader. Combustion gas may travel through the valve body 126 into a chamber 125 within the auto loader 115 where the chamber pressure will increase to actuate the piston 123 of the auto loader 115 (i.e. such that the piston 123 shown in FIG. 6 moves to the left). As shown, the piston 123 has a piston head in fluid communication with the chamber 125, and the piston head, in part, defines the chamber 125. As also shown, the valve body 126 is in fluid communication with the chamber 125, and the valve body, in part, defines the chamber 125.

As shown in FIG. 6, the valve body 126 may include an inlet port 142 which is configured to fluidly connect the gas ports 131, 132 of the barrel 110 and the auto loader housing 121 with the throttling valve 140 to receive pressurized combustion gas. The valve body 126 may also include an outlet port 146 which is configured to fluidly connect the throttling valve 140 to the chamber 125. As illustrated, the throttling valve 140 includes an annular groove 150 (i.e. spool valve), and when the throttling valve is positioned as it is in FIG. 6, the annular groove 150 fluidly connects the inlet port 142 to the outlet port 146.

The regulator 120 shown in FIG. 6 includes a biasing element 128 which urges the throttling valve 140 toward a first position, also known as a firing position (as shown in FIG. 6). In the embodiment illustrated in FIG. 6, the biasing element 128 is configured to urge the throttling valve 140 toward the piston 123. After a round is fired, the throttling valve 140 is in the first position (i.e. firing position) such that pressurized combustion gases flow through ports 131, 132, and the pressurized gases flow through the inlet port 142, the annular groove 150 of the throttling valve 140, and the outlet port 146, and then into the chamber 125. As combustion gases flow into the chamber 125, the chamber pressure builds.

As the combustion gases flow into the chamber 125, the combustion gases also flow into the expansion area 170 of the valve body 126. As shown in FIG. 6, the expansion area 170 is positioned at a first end of the throttling valve 140, but as discussed below, the expansion area 170 may also be positioned differently, as the invention is not so limited. As the combustion gases flow into the expansion area 170, the pressure in the expansion area 170 also builds. When the pressure exceeds a threshold level in the expansion area 170, as may occur when a high load round is fired, the throttling valve 140 moves against the biasing element 128 from the first position into a second position. In particular, with respect to the embodiment shown in FIG. 6, in the second position, the throttling valve 140 slides in the direction away from the piston 123 such that the annular groove 150 of the throttling valve 140 slides away from the inlet and outlet ports 142, 146. Accordingly, when the pressure in the expansion area 170 exceeds the threshold level, the throttling valve 140 moves into a second position such that the inlet port 142 and outlet port 146 are not in fluid communication with each other, and thus, inlet port 142 is not in fluid communication with the piston 123.

It should be appreciated that the pressure in the chamber 125 may be approximately equal to the pressure in the expansion area 170, such that the throttling valve 140 is configured to move when the pressure in the chamber 125 also exceeds the threshold level. Once the throttling valve 140 is in the second position, pressurized combustion gases from the gas port 131 of the barrel 110 of the firearm cannot flow into the chamber 125, thus preventing the chamber pressure from exceeding the predetermined threshold level.

It should be appreciated that under certain conditions, if the pressure in the chamber 125 and expansion area 170 does not exceed a threshold level, then the throttling valve 140 may not move, and thus, it may remain in the first position (open position). In one particular configuration, the regulator 120 is designed such that the throttling valve 140 will only move into the second (i.e. closed) position if the firearm shoots high pressure ammunition. In one embodiment, the throttling valve 140 is configured such that a pressure of approximately 8,000 psi or less is not enough to move the throttling valve, and a pressure of approximately 15,000 psi or greater is enough to move the throttling valve 140 into the second position. In another embodiment, the throttling valve 140 is configured such that a pressure of approximately 12,000 psi or less is not enough to move the throttling valve, and a pressure of approximately 20,000 psi or greater is enough to move the throttling valve 140 into the second position. In yet another embodiment, the throttling valve 140 is configured such that a pressure of approximately 20,000 psi or less is not enough to move the throttling valve, and a pressure of approximately 30,000 psi or greater is enough to move the throttling valve 140 into the second position. One of ordinary skill in the art will appreciate that the threshold pressure to move the throttling valve 140 may be designed based upon one or more of the following parameters: spring constant of the biasing element, shape and configuration of the throttling valve, and shape and configuration of the valve body, including the inlet and outlet ports and the expansion area 170.

It should also be appreciated that as the pressure within the chamber 125 and expansion area 170 drops, the biasing element 128 may move the throttling valve 140 back to the first position (the firing position). Furthermore, in the embodiment illustrated in FIG. 6, the biasing element 128 is a helical spring. It is to be appreciated that a helical spring represents but one type of biasing element that may be utilized in the regulator 120 and that other types of biasing elements are also contemplated, including, but not limited to, Belleville washers, slotted disc springs, coiled springs, serrated disc springs, resilient polymers, gas-filled chambers, and the like.

As set forth in greater detail below with respect to other embodiments, the shape and configuration of both the valve body 126 and the throttling valve 140 may vary according to different embodiments of the present invention. In the embodiment illustrated in FIG. 6, the inlet and outlet ports 142, 146 are elongated channels extending through the valve body 126. Although substantially straight channels and substantially L-shaped channels with approximately 90° angles are shown, other channel configurations are also contemplated as the invention is not so limited. Furthermore, as shown in FIG. 6, the valve body 126 may also include a pressure monitoring station 144 which is a channel that fluidly connects the gas port 132 with the above described expansion area 170. Additionally, the regulator 120 may also include an access plug 160 positioned within the valve body 126. As shown in FIG. 6, the access plug 160 may separate the chamber 125 from the expansion area 170. It may be desirable to remove the access plug 160 for periodic maintenance and cleaning of the regulator 120.

As mentioned above, regulators may be constructed so that the escape of combustion gas from the chamber or other portions of the auto loader and/or regulator is prevented. According to one embodiment, the throttling valve 140 is constructed and arranged to prevent combustion gas from escaping from the regulator to an ambient environment, other than through the barrel 110 of the firearm. The interface between the various regulator components may be a precision fit to prevent the passage of combustion gases there between.

Now turning to FIG. 7, another embodiment of a regulator 220 for an auto loader that includes a throttling valve 240 is illustrated, and will now be described.

Similar to the embodiment illustrated in FIG. 6, when a round is fired, pressurized combustion gas passes through the gas port 131 in the barrel 110 and through one or more corresponding gas ports 132 of the auto loader. Combustion gas may travel through the inlet port 244 and outlet port 246 of the valve body and then into a chamber 270 within the auto loader housing 221 where the chamber pressure will increase to actuate the piston 280. The throttling valve 240 includes an annular groove 262 (i.e. spool valve), and when the annular groove 262 is aligned with the inlet and outlet ports 244, 246, the combustion gases can flow from the barrel 110 into the chamber 270. As shown in FIG. 7, a first end of the throttling valve 240 is positioned within the chamber 270. This is in contrast to the embodiment shown in FIG. 6, where the first end of the throttling valve 140 is spaced apart from the chamber 125.

Figure 7:
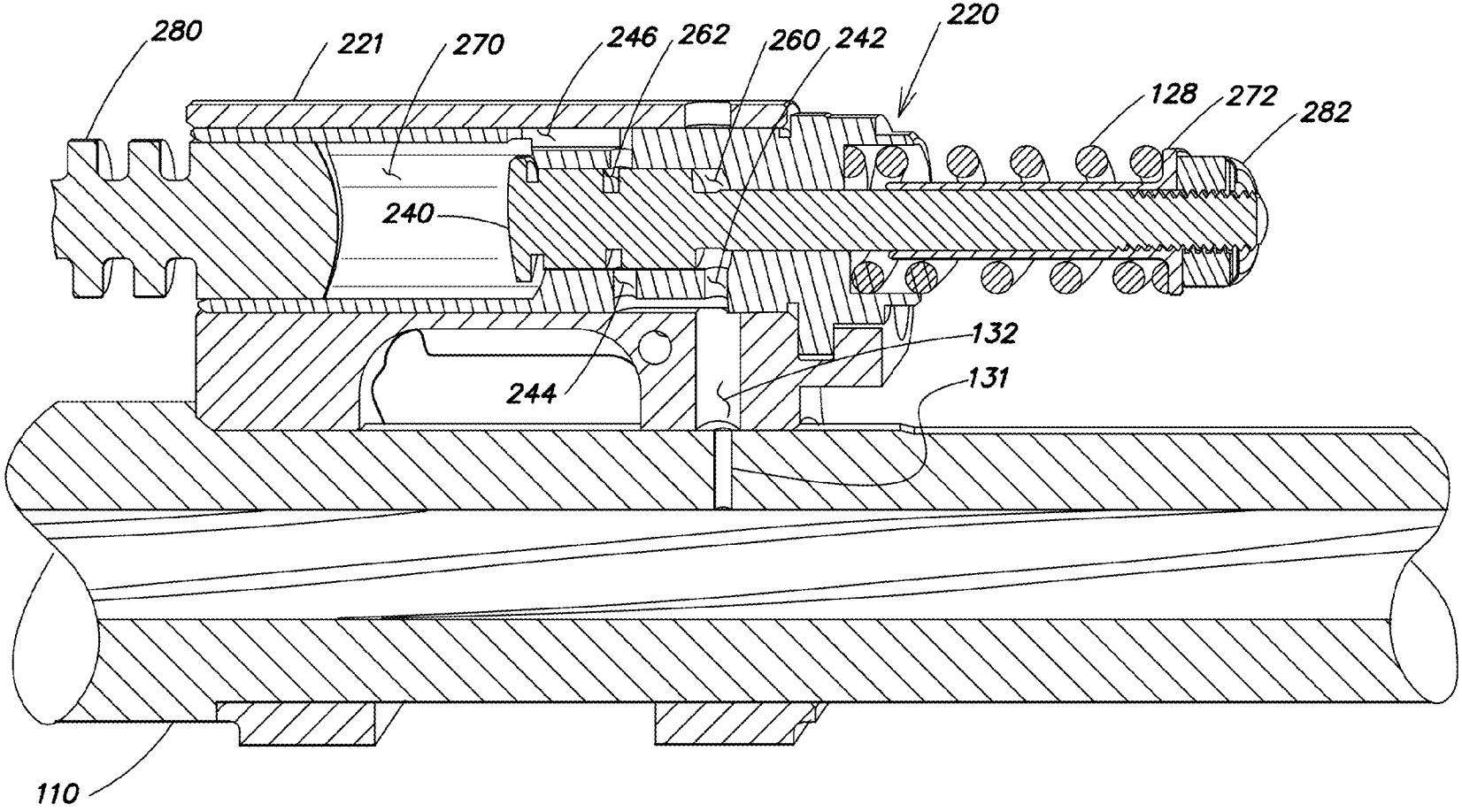
FIG. 7 shows another embodiment of a regulator for an auto loader that includes a throttling valve.

The regulator 220 shown in FIG. 7 also includes a biasing element 128 which urges the throttling valve 240 toward a first position. In the embodiment illustrated in FIG. 7, the biasing element 128 is configured to urge the throttling valve 240 away from the piston 280. This is opposite the configuration shown in FIG. 6. In the schematic illustration of FIG. 7, a cover for the biasing element 128 has been omitted. One of ordinary skill in the art would appreciate that a cover or outer housing for the biasing element (as shown in FIG. 6) may be implemented, as the invention is not so limited.

As the combustion gases flow into the chamber 270, the combustion gases also flow into the expansion area 260 of the valve body. As shown in FIG. 7, the expansion area 260 is positioned at an intermediate section of the throttling valve 240 and a pressure monitoring station 242 fluidly connects the gas port 132 with the expansion area 260. As the combustion gases flow into the expansion area 260, the pressure in the expansion area 260 also builds. When the pressure exceeds a threshold level in the expansion area 260, as may occur when a high load round is fired, the throttling valve 240 moves against the biasing element 128 from the first position into a second position. In particular, with respect to the embodiment shown in FIG. 7, in the second position, the throttling valve 240 slides in the direction toward the piston 280 such that the annular groove 262 of the throttling valve 240 slides to become out of alignment with the inlet and outlet ports 244, 246. Accordingly, when the pressure in the expansion area 260 exceeds the threshold level, the throttling valve 240 moves into a second position such that the inlet and outlet ports 244, 246 are not in fluid communication with each other. As mentioned above, it should be appreciated that under certain conditions, if the pressure in the chamber 270 and expansion area 260 does not exceed a threshold level, then the throttling valve 240 may not move, and it may remain in the first position.

In the embodiment illustrated in FIG. 7, the expansion area 260 is substantially annular shaped. However, other shapes and configurations are also contemplated as the invention is not so limited.

As the pressure within the chamber 270 and expansion area 260 drops, the biasing element 128 may move the throttling valve 240 back to the first position (i.e. the firing position). However, the inventors recognized that it is conceivable that under certain circumstances, such as repeated use, the biasing element 128 may fail which may prevent the throttling valve 240 from moving back into the firing position. Such an occurrence could render the firearm inoperable, as it can result in a spent round being left in the firearm after firing and/or it may prevent a new round from being reloaded in the firearm. Accordingly, the inventors developed the embodiment disclosed in FIG. 7 which features a "fail-safe function". In particular, in the event that the biasing element 128 fails and the throttling valve 240 remains in the second position, the piston 280 and throttling valve 240 may be configured such that the piston 280 can move the throttling valve 240 back into the first position. For example, as shown in FIG. 7, the piston 280 may be automatically or manually pushed to the right such that the piston head contacts the first end of the throttling valve to physically push the throttling valve 240 back into the first position. A regulator 220 featuring this "fail-safe function" may be desirable to keep the gas ports 131, 132 open to the chamber 270 for the next round.

Figure 8:
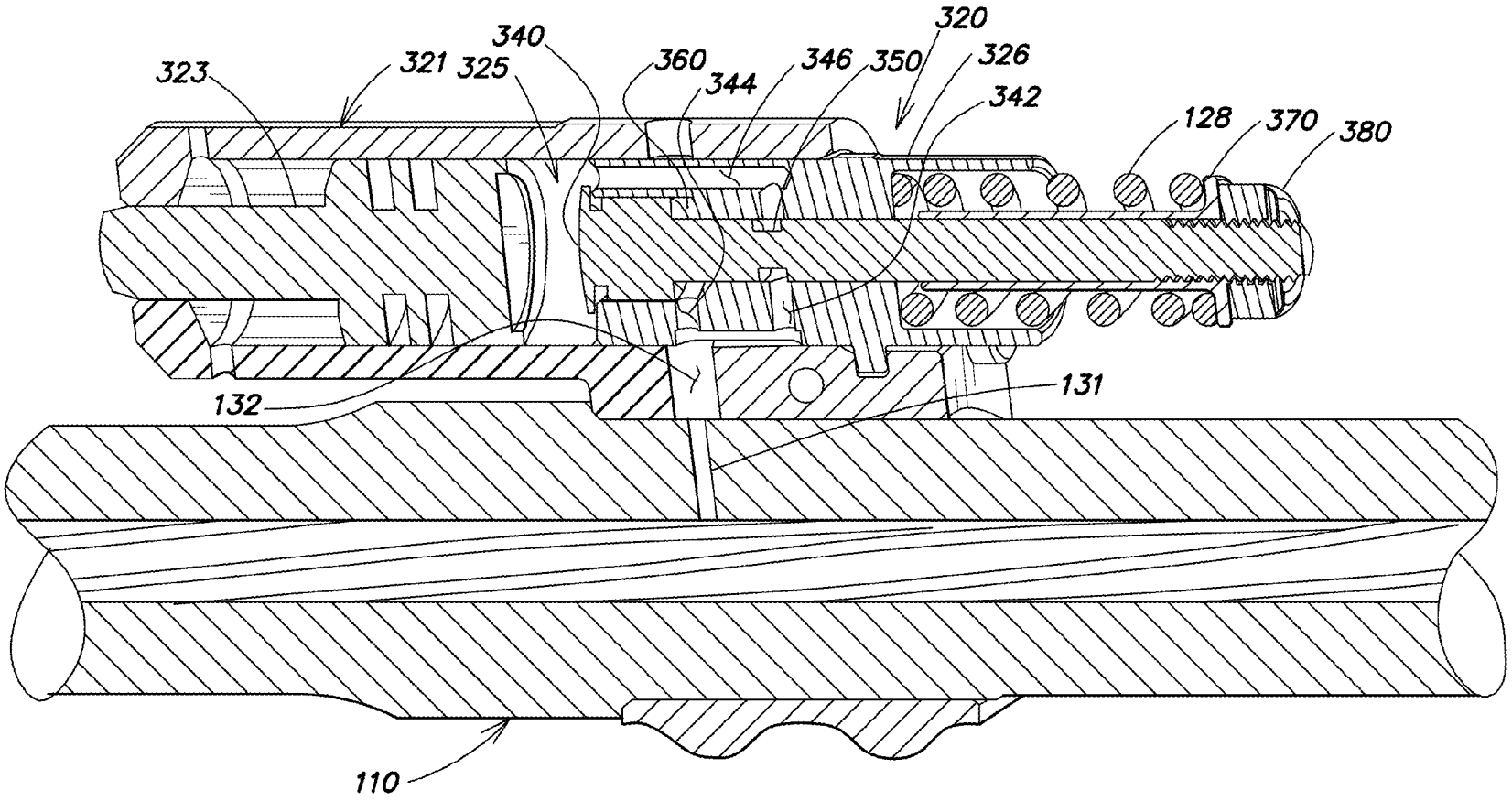
FIG. 8 shows yet another embodiment of a regulator for an auto loader that includes a throttling valve.

The embodiment illustrated in FIG. 8 is another variation of a regulator 320 for an auto loader that includes a throttling valve 340 which includes the above-described "fail-safe function". Pressurized combustion gas passes through the gas port 131 in the barrel 110 and through one or more corresponding gas ports 132 of the auto loader. Combustion gas travels through the inlet port 342 and outlet port 346 of the valve body 326 and then into a chamber 325 within the auto loader housing 321 where the chamber pressure will increase to actuate the piston 323. The throttling valve 340 includes an annular groove 350 (i.e. spool valve), and when the annular groove 350 is aligned with the inlet and outlet ports 342, 346, the combustion gases can flow from the barrel 110 into the chamber 325.

A biasing element 128 urges the throttling valve 340 toward a first position. In the embodiment illustrated in FIG. 8, the biasing element 128 is configured to urge the throttling valve 340 away from the piston 323. In the schematic illustration of FIG. 8, a cover for the biasing element 128 has been omitted. One of ordinary skill in the art would appreciate that a cover or outer housing for the biasing element (as shown in FIG. 6) may be implemented, as the invention is not so limited.

As shown in FIG. 8, an expansion area 360 is positioned at an intermediate section of the throttling valve 340 and a pressure monitoring station 344 fluidly connects the gas port 132 with the expansion area 360. When the pressure exceeds a threshold level in the expansion area 360, as may occur when a high load round is fired, the throttling valve 340 moves against the biasing element 128 from the first position into a second position. With respect to the embodiment shown in FIG. 8, in the second position, the throttling valve 340 slides in the direction toward the piston 323 such that the annular groove 350 of the throttling valve 340 slides to become out of alignment with the inlet and outlet ports 342, 346. Accordingly, when the pressure in the expansion area 360 exceeds the threshold level, the throttling valve 340 moves into a second position such that the inlet and outlet ports 342, 346 are not in fluid communication with each other. As mentioned above, it should be appreciated that under certain conditions, if the pressure in the chamber 325 and expansion area 360 does not exceed a threshold level, then the throttling valve 340 may not move, and it may remain in the first position, with barrel, gas ports 131, 132, inlet port 342, annular groove 350, outlet port 346 and chamber 325 all in fluid communication.

As mentioned above, as the pressure within the chamber 325 and expansion area 360 drops, the biasing element 128 may move the throttling valve 340 back to the first position (i.e. the firing position). However, in the event that the biasing element 128 fails and the throttling valve 340 remains in the second position, the piston 323 may be configured to move the throttling valve 340 back into the first position. For example, as shown in FIG. 8, the piston 323 may be automatically or manually pushed to the right such that the piston head contacts the first end of the throttling valve 340 to physically push the throttling valve 340 back into the first position. A regulator 320 featuring this "fail-safe function" may be desirable to keep the gas ports 131, 132 open to the chamber 325 for loading the next round.

As shown in FIGS. 6-8, any of the above-described regulators 120, 220, 320 may further include a stroke limiter 272, 370 which is configured to limit the movement of the throttling valve beyond a predetermined maximum distance. The regulators 120, 220, 320 may also include an end cap 180, 282, 380 to adjust the preloaded tension on the biasing element 128.

As mentioned above, another way to reduce the chamber pressure in the regulator for a firearm auto loader is to implement a valve that includes a vent hole which is configured to vent combustion gas from the chamber. Such an embodiment will now be described with respect to FIGS. 9-14.

Figure 9:
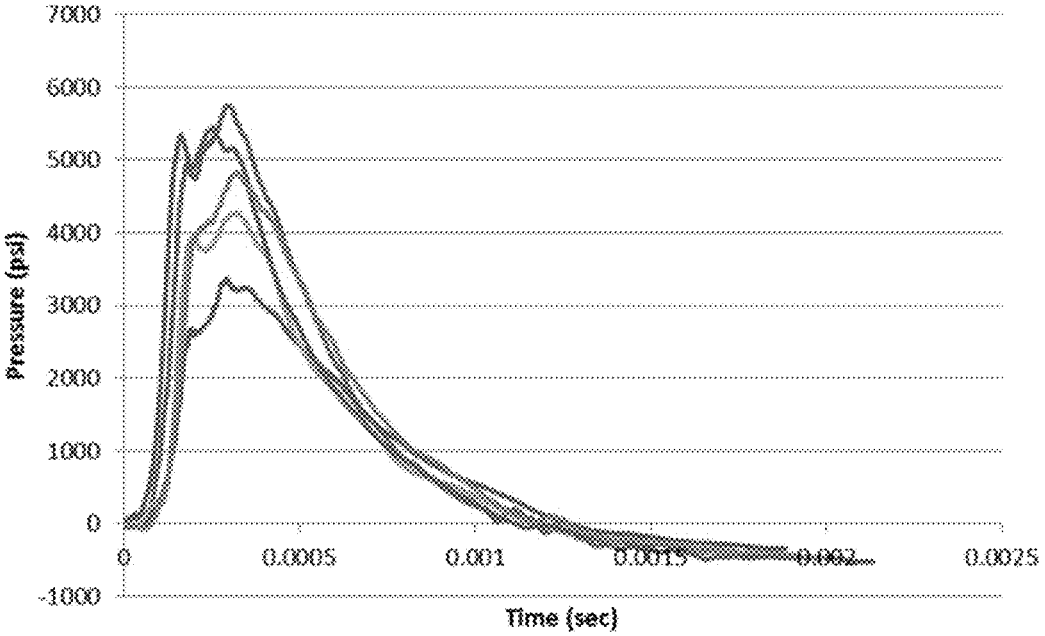
FIG. 9 is a plot of auto loader gas chamber pressures in an unregulated 9 mm firearm for rounds having different loads, according to one embodiment.

FIG. 9 illustrates gas chamber pressure levels for a firearm that does not include a regulator, for different types of 9 mm rounds. As shown, peak pressure levels in the gas chamber of the firearm may vary between approximately 3400 psi and 5800 psi, or equivalently up to 70% depending on the load of the round that is being fired. The higher gas chamber pressures shown in FIG. 9 are accompanied by greater areas under corresponding pressure versus time plots and thus represent greater amounts of energy delivered to the auto loader from the firing of a round. Greater energy amounts can cause a piston of the auto loader to move with higher velocity and can cause the overall auto loader and firearm to cycle at a rate higher than intended.

Figure 10:
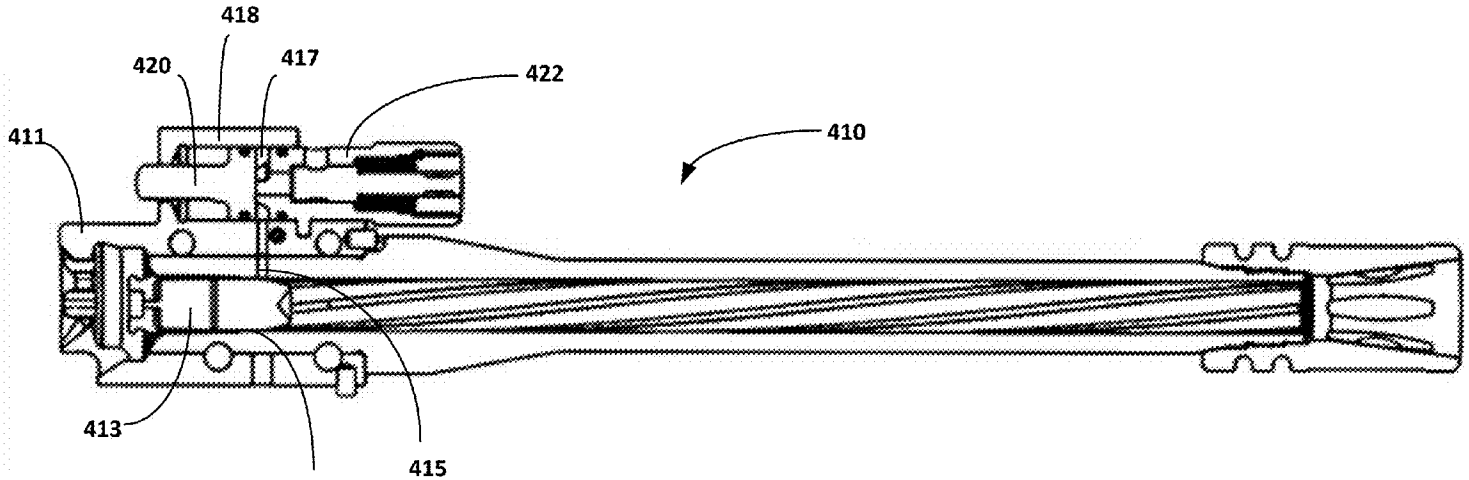
FIG. 10 is a cross-sectional view of a barrel assembly of a firearm, including a piston of a gas operated auto loader and regulator, according to one embodiment.

FIG. 10 illustrates one embodiment of a firearm barrel assembly 410 that utilizes a gas operated auto loader 418 and a regulator 422. As shown, a firing chamber 412 lies at the breach end 411 of the barrel and receives a round 413 for firing. A gas port 415 provides fluid communication between a forward area of the firing chamber 412 and a gas chamber 417 of a gas operated auto loader 418. The auto loader 418 includes a piston 420 that faces the gas chamber 417 and which is movable in the auto loader. The piston 420 is connected, either directly or indirectly, to a bolt or bolt carrier (not shown) of the firearm such that movement of the piston cycles the action of the firearm.

After a round is fired, pressurized combustion gases pass through the gas port 415 from the firing chamber of the barrel and into the gas chamber 417. As pressure builds in the gas chamber, the piston 420 is moved rearward to, in turn, move the bolt of the firearm rearward. Rearward movement of the bolt acts to unlock the breach of the firearm and to extract and eject the round 413 that has been fired. The bolt then returns to the forward position by a spring or other mechanism to load a fresh round in the firing chamber for subsequent firing.

Figure 11:
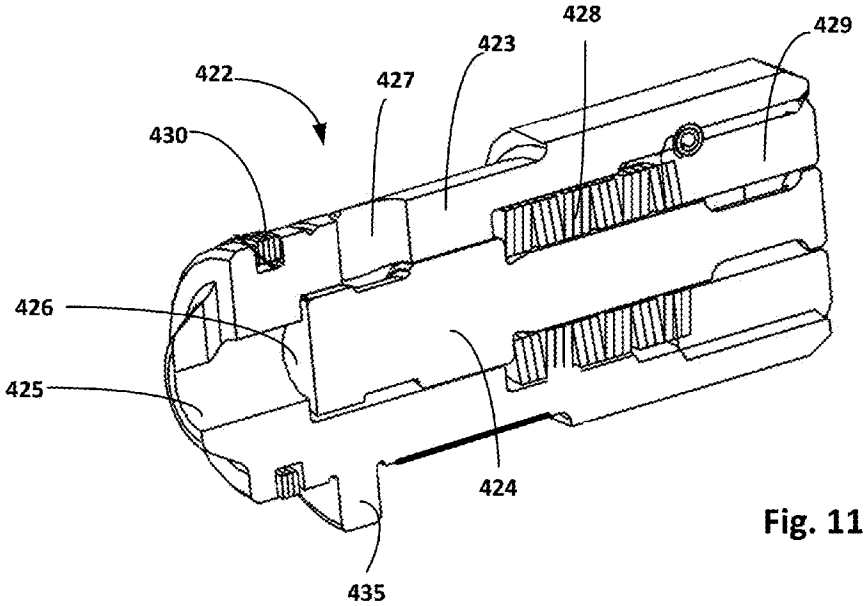
FIG. 11 is a cross-sectional perspective view of the regulator shown in FIG. 10.

FIG. 11 is a cross sectional perspective view of the regulator 422 that is shown assembled to the barrel assembly 410 in the embodiment of FIG. 10. The regulator includes a body 423 that is mounted to the barrel assembly 410 and auto loader 418 in a manner that exposes an inlet 425 of the regulator 422 to the gas chamber 417. A seal 430 is located in a groove that lies on the periphery of the valve body 423 and mates with a corresponding feature of the auto loader to prevent unintended escape of combustion gas from the gas chamber. A valve stem 424 is movable within the valve body 423 between a closed position as shown, where passage of gas through the regulator is prevented, and an open position where combustion gas is allowed to escape from the gas chamber 417 through vent port 427. A biasing element 428 that is held in place by an adjustment cap 429 biases the valve stem 424 in the closed position.

The inlet 425 of the valve body 423 faces the gas chamber 417 of the auto loader 418 and exposes a face 426 of the valve stem to the pressure of any combustion gas in the gas chamber 417. When pressure in the gas chamber is greater than a set point of the regulator, forces acting on the face 426 of the valve stem 424 move the valve stem away from the closed position against the biasing element and toward the open position. In the open position, combustion gas passes into the valve body 423 through inlet 425 and escape the valve body through vent 427 to relieve excess pressure from the gas chamber, thus reducing the amount of energy that is applied to the piston of the auto loader. When a low load round is fired, the set point of the regulator may not be exceeded, such that the valve stem 424 remains closed during operation so that gas port 415 is not in fluid communication with vent port 427.

Various features of the regulator may control when and/or how the valve stem moves from the closed position. The area of face 426 of the valve stem 424 that is exposed to the inlet 425 may determine how much force is applied to the valve stem by pressurized combustion gas in the gas chamber 417. The size and/or shape of the inlet 425 may be constructed to control the amount of force initially applied to the valve stem face 426 by combustion gas in the gas chamber 417. The size of the inlet 425, the vent 427, and any passage there between in the valve body may additionally affect the rate at which combustion gas is released when the valve stem is moved to the open position. The weight of the valve stem and volume of the gas chamber may also be adjusted by a designer to tune dynamics of the valve stem.

Biasing elements may be configured to control operating characteristics of any of the above described regulators. In the illustrated embodiment of FIGS. 10-11, the biasing element includes six sets of Belleville washer stacks arranged in series. Each Belleville washer stack includes three Belleville washers arranged in parallel with one another. The number of sets of Belleville washers and the number of washers in each stack may be adjusted to increase or decrease the dynamic response and initial opening pressure/force of the valve stem in order to tune the regulator for a particular firearm type. It is to be appreciated that Belleville washers represent but one type of biasing element that may be utilized in a regulator and that other types of biasing elements are also contemplated, including, but not limited to, slotted disc springs, serrated disc springs, and coil springs constructed of various materials, including steel, resilient polymers, gas-filled chambers and the like.

Figure 12:
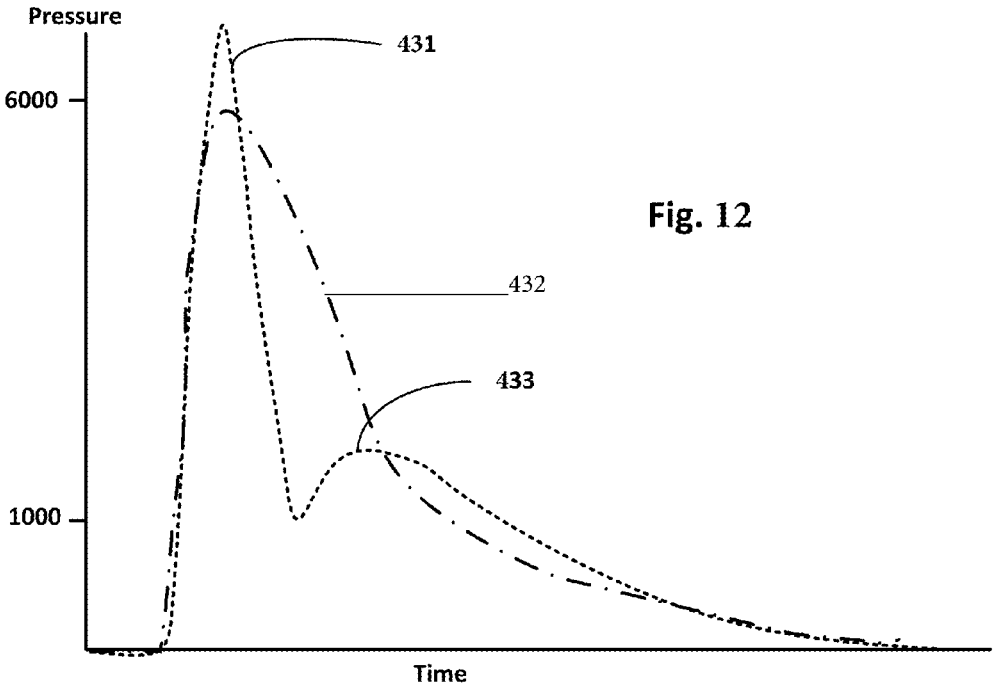
FIG. 12 illustrates plots of an auto loader gas chamber pressure for a high load round fired from a 9 mm firearm both without and with a regulator, according to one embodiment.

FIG. 12 show plots of combustion gas pressure in the gas chamber of an auto loader of a 9 mm firearm firing a high load round. A first plot 431 is for a high load round fired from a firearm having a regulator similar to that disclosed in FIGS. 10-11 and a second plot 432 is for the same high load round fired from a firearm which does not have a regulator. As shown, pressures for each of the regulated 431 and unregulated 432 auto loaders each reach approximately 6000 psi. However, the curve for the regulated auto loader tapers off sharply to a value of about 1000 psi after reaching peak pressure, resulting in less area under the overall curve despite reaching a higher peak pressure. The lower area under the curve for the regulated auto loader represents energy being dissipated through the regulator and a reduced auto loader piston velocity, as compared to the unregulated auto loader. A second peak 433 is apparent in the pressure plot for the regulated 431 auto loader and which occurs subsequent to the valve stem of the regulator returning to the closed position, after venting combustion gases to relieve pressure and energy for the auto loader. Bolt carrier velocity associated with the regulated auto loader shown in FIG. 12 peaked at 364 inches per second, which is a 20% decrease relative to the 434 inches per second bolt carrier velocity associated with an unregulated auto loader.

The regulator associated with the plot of FIG. 12 was generally constructed as shown in FIGS. 10-11, with a 0.156 inch inlet diameter, a 0.125 inch vent port diameter, 180 pounds of pre load applied to the valve stem by 10 parallel sets of 2 Belleville washer stacks arranged in series, with each Belleville washing having a 0.34 inch diameter. The allowed stroke of the valve was 0.025 inches. The face of the valve stem was constructed to engage the valve body in a flat arrangement.

Figure 13:
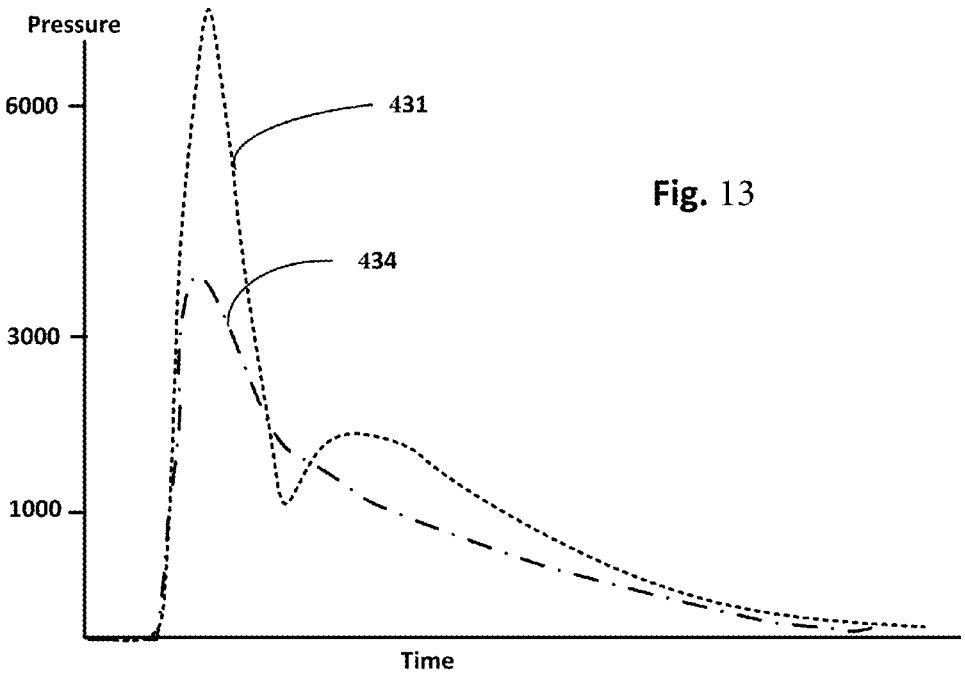
FIG. 13 illustrates plots of an auto loader gas chamber pressure for both a high load round and a low load round fired from a 9 mm firearm with a regulator, according to one embodiment.

FIG. 13 shows a plot 434 of combustion gas pressure in the gas chamber of a regulated auto loader for the 9 mm firearm associated with the plots of FIG. 12, but for the firing of a low load round. As shown, pressure peaks at about 3800 psi before dissipating back to zero. The low load plot lacks a sharp pressure decay followed by a second peak associated with opening and closing of the regulator valve, indicating that the regulator remained closed after firing the low load round, as intended. The plot for a high load round 431 of FIG. 12 is shown in FIG. 13 for comparison with the plot for the low load round 434.

Figure 14:
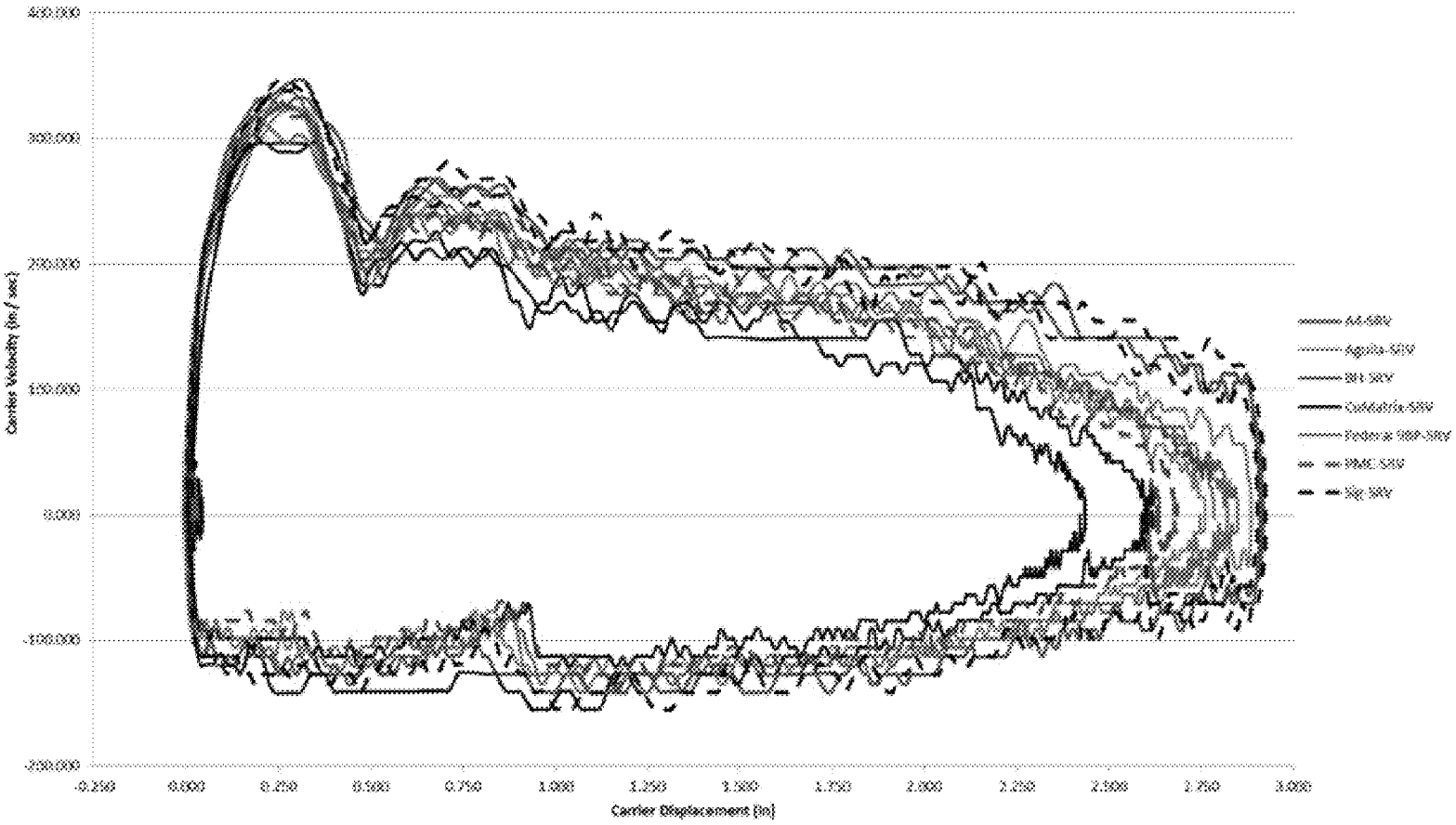
FIG. 14 shows a plot of bolt carrier velocity versus bolt carrier position over one or more cycles of operation of a 9 mm firearm for rounds having different loads, according to one embodiment.

FIG. 14 illustrates a plot for velocity of the bolt carrier in a 9 mm firearm versus bolt carrier position in a firearm having a regulated auto loader according to one embodiment. As shown, peak velocities range between about 300 inches per second and 350 inches per second, representing a reduced velocity variation with respect to an unregulated auto loader for the same firearm. The majority of rounds represented in the plot of FIG. 14 result in peak bolt carrier velocities between 325 and 375 inches per second, which has been identified as a range of preferred peak velocities.

The regulator 422 may be assembled to the barrel assembly 410 or other portions of a firearm in different manners. According to some embodiments, the assembly may be managed without tools, such that an operator may remove and/or replace a regulator in a field strippable manner. As shown in FIGS. 10 and 11, the regulator 422 may include a tab 435 that is received in a corresponding cavity barrel assembly 410 to secure the regulator in position. Rotation of the regulator relative to the barrel assembly may serve to engage and disengage the tab 435, according to an embodiment. Other engagement features are also contemplated.

Examples

The following examples describe details of some of the embodiments disclosed herein. The first example is a regulator for a gas operated firearm auto loader, comprising a chamber constructed and arranged to receive pressurized combustion gas from a gas port of a barrel of the firearm when a round is fired from the firearm, a piston having a piston head in fluid communication with said chamber, the piston constructed and arranged to move away from a firing position to actuate at least a portion of a cycle of the firearm when urged by pressurized combustion gas received in said chamber; and a throttling valve in fluid communication with said chamber, the throttling valve having a first position in which pressurized combustion gas from the gas port of a barrel of a firearm can flow into the chamber, and a second position in which pressurized combustion gas from the gas port of a barrel of a firearm cannot flow into the chamber, and wherein the throttling valve is configured to move from the first position to the second position when pressure in the chamber exceeds a threshold level.

Example 2 is the regulator of example 1, further comprising a valve body in fluid communication with said chamber, wherein the throttling valve is received within the valve body.

Example 3 is the regulator of example 2, wherein the valve body further comprises an inlet port which is configured to fluidly connect the gas port of a barrel of the firearm with the throttling valve to receive pressurized combustion gas when the throttling valve is in the first position.

Example 4 is the regulator of example 3, wherein the valve body further comprises an outlet port which is configured to fluidly connect the throttling valve to the chamber to receive pressurized combustion gas when the throttling valve is in the first position.

Example 5 is the regulator of example 4, wherein the valve body further comprises an expansion area positioned at a first end of the throttling valve, the expansion area configured to receive pressurized combustion gas from the gas port of a barrel of a firearm, and wherein when the pressure in the expansion area exceeds a threshold level, the pressure in the expansion area moves the throttling valve from the first position to the second position.

Example 6 is the regulator of example 5, further comprising an access plug positioned within the valve body, wherein the access plug separates the chamber from the expansion area.

Example 7 is the regulator of example 4, wherein the valve body further comprises an expansion area positioned at an intermediate section of the throttling valve, the expansion area configured to receive pressurized combustion gas from the gas port of a barrel of a firearm, and wherein when the pressure in the expansion area exceeds a threshold level, the pressure in the expansion area moves the throttling valve from the first position to the second position.

Example 8 is the regulator of example 7, wherein the expansion area is substantially annular shaped.

Example 9 is the regulator of example 4, wherein the throttling valve includes an annular groove, wherein when the throttling valve is in the first position, the annular groove fluidly connects the inlet port to the outlet port, and when the throttling valve is in the second position, the inlet port and outlet port are not in fluid communication.

Example 10 is the regulator of example 1, wherein the throttling valve is urged toward the first position by a biasing element.

Example 11 is the regulator of example 10, wherein the biasing element is configured to urge the throttling valve toward the piston.

Example 12 is the regulator of example 10, wherein the biasing element is configured to urge the throttling valve away from the piston.

Example 13 is the regulator of example 12, wherein the piston and throttling valve are configured such that if the biasing element fails, and the throttling valve remains in the second position, the piston can move the throttling valve back into the first position.

Example 14 is the regulator of example 1, wherein the throttling valve is constructed and arranged to prevent combustion gas from escaping from said regulator to an ambient environment other than through the barrel of the firearm.

Example 15 is the regulator of example 1, further comprising a stroke limiter configured to limit movement of the throttling valve beyond a predetermined maximum distance.

Example 16 is the regulator of example 1, wherein a first end of the throttling valve is positioned within the chamber.

Example 17 is a regulator for a gas operated automated firearm, comprising a gas chamber constructed and arranged to receive pressurized combustion gas from a gas port of a barrel of the firearm when a round is fired from the firearm, a piston having a piston head in fluid communication with said gas chamber, said piston constructed and arranged to move away from a firing position to actuate at least a portion of a cycle of the firearm when urged by pressurized combustion gas received in said gas chamber, and an expansion valve in fluid communication with said gas chamber and constructed and arranged to move from a firing position to increase a volume of said gas chamber when pressure in the gas chamber exceeds a threshold level.

Example 18 is the regulator of example 17, wherein said expansion valve is constructed and arranged to prevent combustion gas from escaping from said regulator to an ambient environment other than through the barrel of the firearm.

Example 19 is the regulator of example 18, wherein a blowby vent provides a vent for combustion gas that escapes from the gas chamber by the expansion valve.

Example 20 is the regulator of example 17, wherein said expansion valve is urged toward the firing position by a biasing element.

Example 21 is the regulator of example 17, wherein a positive stop limits movement of the expansion valve beyond a maximum amount of travel away from the firing position.

Example 22 is the regulator of example 17, wherein a throttle reduces flow of pressurized combustion gas to said gas chamber after said expansion valve moves from said firing position.

Example 23 is the regulator of example 22, wherein said throttle includes an outer surface of said expansion valve that at least partially closes said gas port when the expansion valve is moved from the firing position.

Example 24 is the regulator of example 23, wherein said expansion valve includes an opening in a face of said expansion valve that is in fluid communication with said gas port when said expansion valve is in the firing position.

Example 25 is the regulator of example 24, where said expansion valve includes an annular recess that provides fluid communication between said gas port and said opening in a face of said expansion valve.

Example 26 is a regulator for a gas operated automated firearm, comprising a gas chamber having an intake that receives pressurized combustion gas from a gas port of a barrel of the firearm when a round is fired, a piston having a piston head in fluid communication with said gas chamber, said piston constructed and arranged to move a bolt carrier of the firearm by pressurized combustion gas in said gas chamber to actuate at least a portion of an automated cycle of the firearm, and a valve including a vent hole, said valve in fluid communication with said gas chamber and constructed and arranged to vent combustion gas from said gas chamber through said vent hole.

Example 27 is the regulator of example 26, where said valve includes a valve stem and a biasing element, said biasing element constructed and arranged to urge the valve stem to close the vent hole.

Example 28 is the regulator of example 27, wherein said biasing element includes Belleville washers.

Example 29 is the regulator of example 27, wherein said valve includes an adjustment mechanism to adjust preload on Belleville washers.

Example 30 is the regulator of example 26, wherein said valve is constructed and arranged to prevent combustion gas from venting through said vent hole for gas pressures below 3000 psi in said gas chamber.

Example 31 is the regulator of example 26, wherein said valve is constructed and arranged to prevent combustion gas from venting through said vent hole when low load rounds are fired from the firearm.

Example 32 is the regulator of example 26, constructed and arranged to accommodate gas pressures that range between 3000 psi and 5000 psi.

Example 33 is the regulator of example 26, operable for low load round and high load rounds without operator intervention to adjust said regulator.

Example 34 is the regulator of example 26, constructed and arranged to maintain bolt carrier velocities below 400 inches per second.

Example 35 is the regulator of example 27, in combination with said firearm.

Example 36 is the combination of example 35, wherein said firearm is constructed and arranged to fire 9 mm rounds.

Example 37 is a method of regulating gas pressure in gas operated firearm automation, comprising receiving pressurized combustion gas in a gas chamber of a regulator upon firing of a firearm, moving a bolt carrier of the firearm by urging a piston with the pressurized combustion gas in the gas chamber of the regulator, and venting combustion gas from the gas chamber through a vent hole when pressure in the gas chamber exceeds a set point.

Example 38 is the method of example 37, wherein moving the bolt carrier of the firearm includes moving the bolt carrier at velocities less than 400 inches per second by venting combustion gas from the gas chamber through the vent hole.

Example 39 is the method of example 37, further comprising preventing venting of combustion gas from the gas chamber when gas pressure in the gas chamber is less than a set point.

Example 40 is the method of example 39, wherein the set point is 3000 psi or greater.

While several embodiments have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of this disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of this disclosure is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, along with other embodiments that may not be specifically described and claimed.

All definitions, as defined herein either explicitly or implicitly through use should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A regulator for a gas operated firearm auto loader, comprising:

a chamber constructed and arranged to receive pressurized combustion gas from a gas port of a barrel of the firearm when a round is fired from the firearm;

a piston having a piston head in fluid communication with said chamber, the piston constructed and arranged to move away from a firing position to actuate at least a portion of a cycle of the firearm when urged by pressurized combustion gas received in said chamber; and a throttling valve in fluid communication with said chamber, the throttling valve having a first position in which pressurized combustion gas from the gas port of a barrel of a firearm can flow into the chamber, and a second position in which pressurized combustion gas from the gas port of a barrel of a firearm cannot flow into the chamber, and wherein the throttling valve is configured to move from the first position to the second position when pressure in the chamber exceeds a threshold level.

2. The regulator of claim 1, further comprising a valve body in fluid communication with said chamber, wherein the throttling valve is received within the valve body.

3. The regulator of claim 2, wherein the valve body further comprises an inlet port which is configured to fluidly connect the gas port of a barrel of the firearm with the throttling valve to receive pressurized combustion gas when the throttling valve is in the first position.

4. The regulator of claim 3, wherein the valve body further comprises an outlet port which is configured to fluidly connect the throttling valve to the chamber to receive pressurized combustion gas when the throttling valve is in the first position.

5. The regulator of claim 4, wherein the valve body further comprises an expansion area positioned at a first end of the throttling valve, the expansion area configured to receive pressurized combustion gas from the gas port of a barrel of a firearm, and wherein when the pressure in the expansion area exceeds a threshold level, the pressure in the expansion area moves the throttling valve from the first position to the second position.

6. The regulator of claim 5, further comprising an access plug positioned within the valve body, wherein the access plug separates the chamber from the expansion area.

7. The regulator of claim 4, wherein the valve body further comprises an expansion area positioned at an intermediate section of the throttling valve, the expansion area configured to receive pressurized combustion gas from the gas port of a barrel of a firearm, and wherein when the pressure in the expansion area exceeds a threshold level, the pressure in the expansion area moves the throttling valve from the first position to the second position.

8. The regulator of claim 7, wherein the expansion area is substantially annular shaped.

9. The regulator of claim 4, wherein the throttling valve includes an annular groove, wherein when the throttling valve is in the first position, the annular groove fluidly connects the inlet port to the outlet port, and when the throttling valve is in the second position, the inlet port and outlet port are not in fluid communication.

10. The regulator of claim 1, wherein the throttling valve is urged toward the first position by a biasing element.

11. The regulator of claim 10, wherein the biasing element is configured to urge the throttling valve toward the piston.

12. The regulator of claim 10, wherein the biasing element is configured to urge the throttling valve away from the piston.

13. The regulator of claim 12, wherein the piston and throttling valve are configured such that if the biasing element fails, and the throttling valve remains in the second position, the piston can move the throttling valve back into the first position.

14. The regulator of claim 10 wherein the biasing element is selected from a spring, a set of washers, a resilient polymer and a pressurized gas cylinder.

15. The regulator of claim 1, wherein the throttling valve is constructed and arranged to prevent combustion gas from escaping from said regulator to an ambient environment other than through the barrel of the firearm.

16. The regulator of claim 1, further comprising a stroke limiter configured to limit movement of the throttling valve beyond a predetermined maximum distance.

17. The regulator of claim 1, wherein a first end of the throttling valve is positioned within the chamber.

18. A firearm in combination with the regulator of claim 1, wherein the firearm is capable of automatic fire with rounds varying in load by greater than 10%.

19. The regulator of claim 1 wherein the throttling valve has a third position where pressurized gas from the gas port flows into the chamber at a rate that is less than when the throttling valve is in the first position and greater than when the throttling valve is in the second position.

* * * * *